US009534848B2

(12) United States Patent
Wang et al.

(10) Patent No.: US 9,534,848 B2
(45) Date of Patent: Jan. 3, 2017

(54) METHOD AND APPARATUS TO REDUCE THERMAL STRESS BY REGULATION AND CONTROL OF LAMP OPERATING TEMPERATURES

(71) Applicant: KLA-Tencor Corporation, Milpitas, CA (US)

(72) Inventors: Jincheng Wang, San Jose, CA (US); Anant Chimmalgi, San Jose, CA (US); Rajeev Patil, Fremont, CA (US); Erik Kim, Sunnyvale, CA (US); Rudolf Brunner, Mountain View, CA (US); Quang Giang, San Francisco, CA (US); Lauren Wilson, San Jose, CA (US); Ken Gross, San Carlos, CA (US); Ilya Bezel, Sunnyvale, CA (US); Dan Scott, San Jose, CA (US); Younus Vora, San Jose, CA (US); Matthew Derstine, Los Gatos, CA (US); Cedric Lasfargues, Castro Valley, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 413 days.

(21) Appl. No.: 13/975,945

(22) Filed: Aug. 26, 2013

(65) Prior Publication Data

US 2014/0060792 A1 Mar. 6, 2014

Related U.S. Application Data

(60) Provisional application No. 61/693,886, filed on Aug. 28, 2012.

(51) Int. Cl.
*F21V 29/00* (2015.01)
*F28C 3/04* (2006.01)
(Continued)

(52) U.S. Cl.
CPC ..... *F28C 3/04* (2013.01); *F21V 29/02* (2013.01); *F21V 29/503* (2015.01); *F21V 29/60* (2015.01); *F21V 19/00* (2013.01)

(58) Field of Classification Search
CPC ..... F28C 3/04; F28C 3/02; F21V 29/02; F21V 29/002
(Continued)

(56) References Cited

U.S. PATENT DOCUMENTS 6,527,418 B1 3/2003 Scherba
7,901,110 B2 * 3/2011 Mulay ..... H01J 7/26 313/11
(Continued)

FOREIGN PATENT DOCUMENTS

JP 2011-146318 A 7/2011
KR 10-2010-0084033 A 7/2010
(Continued)

*Primary Examiner* — Laura Tso
*Assistant Examiner* — Naomi M Wolford
(74) *Attorney, Agent, or Firm* — Suiter Swantz pc llo

(57) ABSTRACT

A fluid input manifold distributes injected fluid around the body of a bulb to cool the bulb below a threshold. The injected fluid also distributes heat more evenly along the surface of the bulb to reduce thermal stress. The fluid input manifold may comprise one or more airfoils to direct a substantially laminar fluid flow along the surface of the bulb or it may comprise a plurality of fluid injection nozzles oriented to produce a substantially laminar fluid flow. An output portion may be configured to facilitate fluid flow along the surface of the bulb by allowing injected fluid to easily escape after absorbing heat from the bulb or by applying negative pressure to actively draw injected fluid along the surface of the bulb and away.

18 Claims, 17 Drawing Sheets

(51) Int. Cl.

| | |
|---|---|
| ***F21V 29/02*** | (2006.01) |
| ***F21V 29/503*** | (2015.01) |
| ***F21V 29/60*** | (2015.01) |
| *F21V 19/00* | (2006.01) |

(58) Field of Classification Search
USPC ..... 362/294, 373
See application file for complete search history.

(56) References Cited

U.S. PATENT DOCUMENTS

| | | | | |
|---|---|---|---|---|
| 2006/0050512 | A1* | 3/2006 | Nakagawa | F21V 29/02 362/264 |
| 2009/0244910 | A1* | 10/2009 | Meng | F21V 23/0442 362/373 |
| 2009/0303724 | A1* | 12/2009 | Bjerre | G03B 21/16 362/294 |
| 2010/0027265 | A1 | 2/2010 | Nauen et al. | |

FOREIGN PATENT DOCUMENTS

| | | | | |
|---|---|---|---|---|
| KR | 10-2011-0023186 | A | 3/2011 | |
| NL | WO 2005045314 | A1 * | 5/2005 | F21V 29/02 |

* cited by examiner

METHOD AND APPARATUS TO REDUCE THERMAL STRESS BY REGULATION AND CONTROL OF LAMP OPERATING TEMPERATURES

PRIORITY

The present application claims the benefit under 35 U.S.C. §119(e) of U.S. Provisional Application Ser. No. 61/693,886, filed Aug. 28, 2012, which is incorporated herein by reference.

FIELD OF THE INVENTION

The present invention is directed generally toward arc lamps, and more particularly toward cooling arc lamp bulbs.

BACKGROUND OF THE INVENTION

In arc lamp and other high output bulbs, residual stress due to thermal creep is a key contributor to bulb breakage. Thermal creep is exacerbated at higher ultraviolet (UV) output power from arc lamps, either in the conventional DC discharge mode of operation or with laser sustained plasmas in lamps, due to the higher absorption of UV light in the glass which leads to increased operating temperatures.

Traditionally, bulbs rely on natural convection for cooling. Natural convection cooling results in a highly asymmetric temperature profile on the lamp. Also, the generally accepted operating lamp temperature limit of less than 750° C. is excessive and results in quick buildup of residual stress. A peak temperature of less than 600° C. would be more sustainable.

Consequently, it would be advantageous if an apparatus existed that is suitable for actively cooling high output bulbs to an operating temperature below 600° C.

SUMMARY OF THE INVENTION

Accordingly, the present invention is directed to a novel method and apparatus for actively cooling high output bulbs to an operating temperature below 600° C.

In one embodiment of the present invention, a fluid input manifold distributes injected fluid around the body of a bulb to cool the bulb below a threshold. The injected fluid also distributes heat more evenly along the surface of the bulb to reduce thermal stress.

In one embodiment, a fluid input manifold may comprise one or more airfoils to direct a substantially laminar fluid flow along the surface of the bulb. In another embodiment, the fluid input manifold may comprise a plurality of fluid injection nozzles oriented to produce a substantially laminar fluid flow.

In one embodiment of the present invention, an output portion may be configured to facilitate fluid flow along the surface of the bulb by allowing injected fluid to easily escape after absorbing heat from the bulb or by applying negative pressure to actively draw injected fluid along the surface of the bulb and away.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the subject matter disclosed, which is illustrated in the accompanying drawings. The scope of the invention is limited only by the claims; numerous alternatives, modifications and equivalents are encompassed. For the purpose of clarity, technical material that is known in the technical fields related to the embodiments has not been described in detail to avoid unnecessarily obscuring the description.

Residual stress due to thermal creep is a key contributor to bulb breakage. This effect is exacerbated at higher UV output power from arc lamps in conventional DC discharge mode and with laser sustained plasmas inside lamps due to the higher absorption of UV light in the glass which leads to increased operating temperatures. The present invention provides a way to better control and optimize lamp operating temperatures, thus reducing creep induced stress levels to safe limits and preventing bulb breakage. Using a modeling approach, safe operation temperature limits of less than 600°

C. keep stress levels from increasing excessively for lamps constructed with various glass materials based on their viscosity properties.

Figure 1:
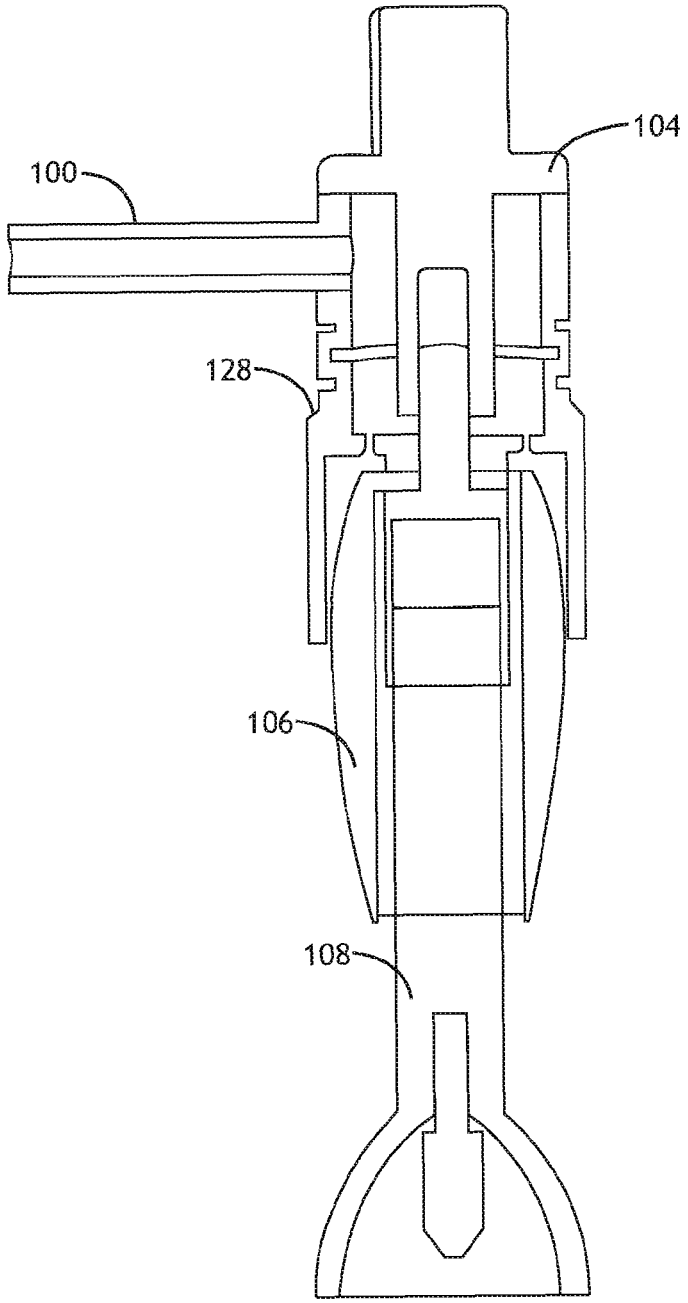
FIG. 1 shows a cross-sectional view of one embodiment of the present invention having an airfoil.

Referring to FIG. 1, a cross-sectional view of one embodiment of the present invention having an airfoil is shown. In at least one embodiment of the present invention, an arc lamp holding node 104 may include a fluid input 100. The fluid input 100 allows fluid to flow into a space defined by a fluid manifold 128. In at least one embodiment, the fluid manifold 128 includes, or directs fluid flow toward, an airfoil element 106. The airfoil element 106 may foster a substantially laminar fluid flow over the surface of a bulb 108. Fluid flow over the surface of the bulb 108 may reduce the temperature of the bulb 108 and more evenly distribute heat across the surface of the bulb 108, resulting in reduced thermal stress.

Airfoil design is effective in controlling lamp temperature for lower laser power operation, but it consumes more than the desired amount of fluid to reach circular uniformity of lamp temperature control during high laser power operation.

Figure 2:
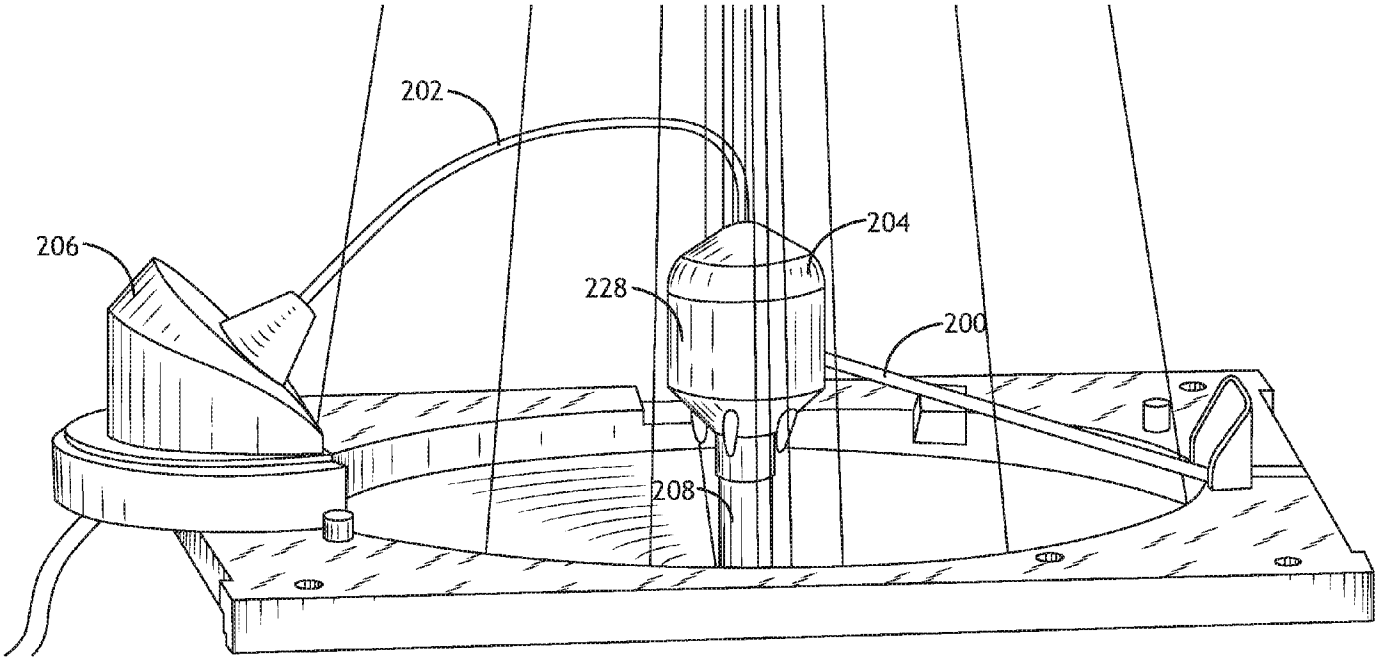
FIG. 2 shows an environmental view of an input portion of one embodiment of the present invention.

Referring to FIG. 2, an environmental view of an input portion of one embodiment of the present invention is shown. In at least one embodiment, a lamp includes a bulb securing locknut 204 that connects one node of a bulb 208 to a power source 206 through a delivery wire 202. The bulb securing locknut 204 may hold a pilot jet assembly 228 in relation to the bulb 208. The pilot jet assembly 228 receives a fluid flow through an input 200 and directs fluid flow over the bulb 208.

Figure 3:
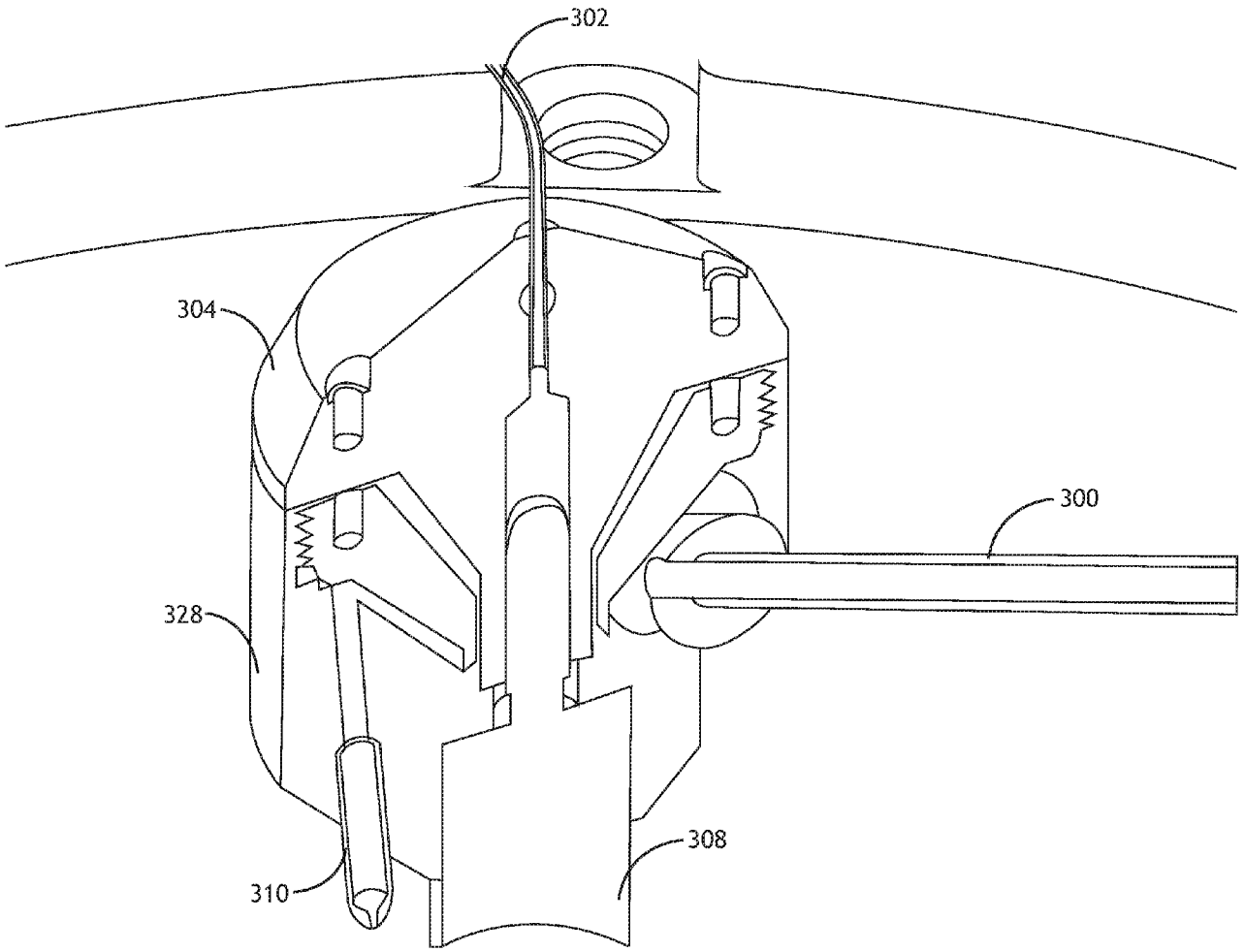
FIG. 3 shows a cross-sectional, detail view of an input portion of one embodiment of the present invention.

Referring to FIG. 3, another cross-sectional, detail view of an input portion of one embodiment of the present invention is shown. The input portion includes a bulb securing locknut 304 to hold a straight pilot jet assembly 328 in relation to a bulb 308 and to allow a delivery wire 302 to contact a node of the bulb 308. The straight pilot jet assembly 328 receives a fluid flow through an input 300 and directs fluid flow over the bulb 308 through a plurality of straight fluid directing jets 310.

The straight pilot jet assembly 328 may be a manifold for distributing a cooling fluid such as air, nitrogen, or other suitable gasses to the plurality of straight fluid directing jets 310. A person skilled in the art may appreciate that fluids useful in some embodiments of the present invention may also include liquids. The plurality of straight fluid directing jets 310 may be distributed substantially uniformly around the straight pilot jet assembly 328. Straight fluid directing jets 310 may produce a high velocity plume that tends to adhere to the surface of the bulb 308. Straight fluid directing jets 310 provide good control over directionality of fluid flow, and a reduced output nozzle (for example, 0.45 mm) may provide additional cooling effect through Joule-Thomson cooling as the fluid exits the nozzle into a lower ambient pressure. In the context of the present invention, "straight" fluid directing jets 310 may be straight in that, for each straight fluid directing jet 310, an axis defined by the straight fluid directing jet 310 and an axis defined by the bulb 308 define a plane. Each straight fluid directing jet 310 may be oriented to direct a fluid flow toward the surface of the bulb 308. In at least one embodiment, the straight fluid directing jets 310 may be oriented to direct the fluid flow toward the "hip" of the bulb 308 (a portion of the bulb 308 where a bulbous intersects a substantially straight portion). Straight fluid directing jets 310 may produce steady state gradients.

Figure 4:
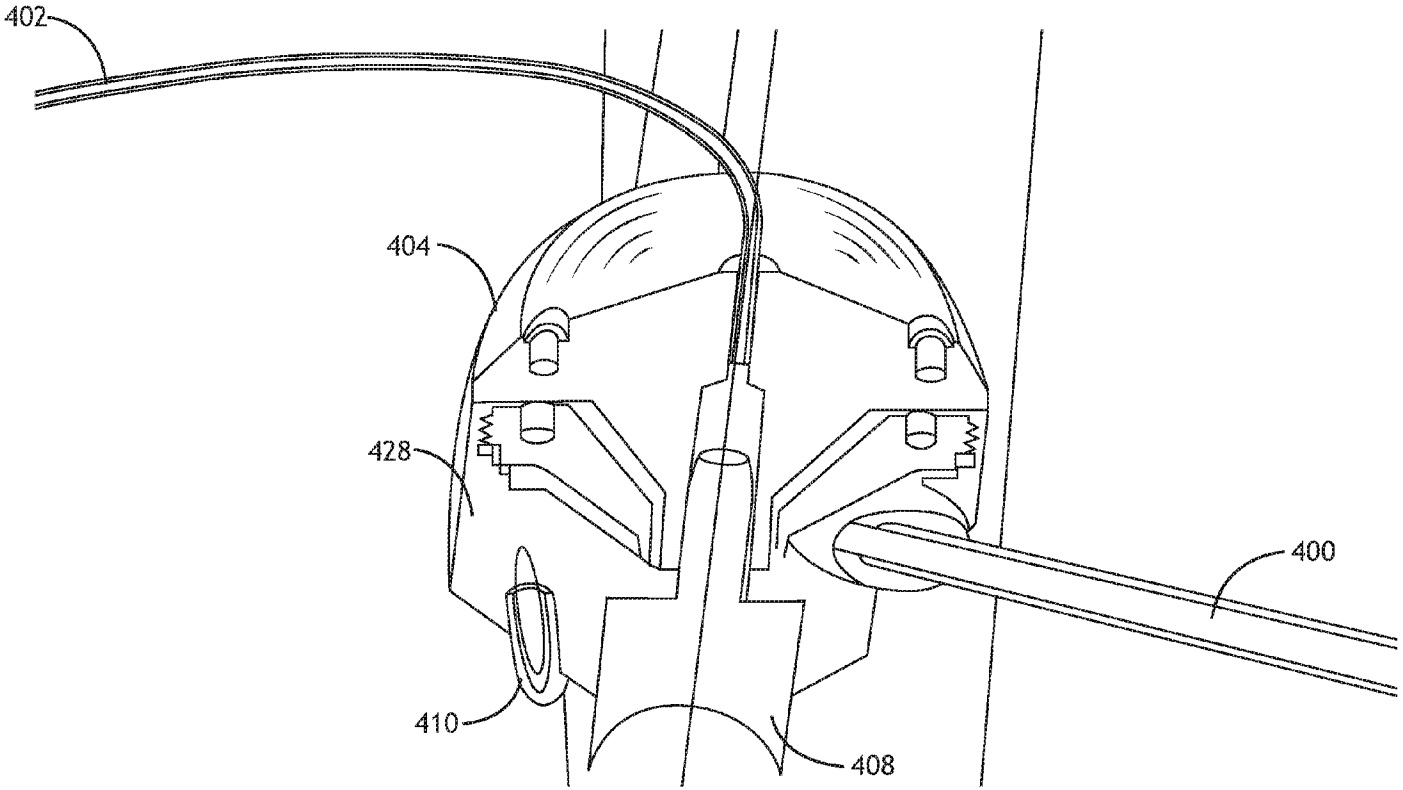
FIG. 4 shows another cross-sectional, detail view of an input portion of one embodiment of the present invention.

Referring to FIG. 4, a cross-sectional, detail view of an input portion of one embodiment of the present invention is shown. The input portion includes a bulb securing locknut 404 to hold an inclined pilot jet assembly 428 in relation to a bulb 408 and to allow a delivery wire 402 to contact a node of the bulb 408. The inclined pilot jet assembly 428 receives a fluid flow through an input 400 and directs fluid flow over the bulb 408 through one or more inclined fluid directing jets 410.

The inclined pilot jet assembly 428 may be a manifold for distributing a cooling fluid to the plurality of inclined fluid directing jets 410. The plurality of inclined fluid directing jets 410 may be distributed substantially uniformly around the inclined pilot jet assembly 428. Inclined fluid directing jets 410 may produce a high velocity plume that tends to adhere to the surface of the bulb 408. Inclined fluid directing jets 410 provide good control over directionality of fluid flow, and a reduced output nozzle (for example, 0.45 mm) may provide additional cooling effect through Joule-Thomson cooling as the fluid exits the nozzle into a lower ambient pressure. In the context of the present invention, "inclined" fluid directing jets 410 may be inclined in that, for each inclined fluid directing jet assembly 410, an axis defined by the inclined fluid directing jet assembly 410 and an axis defined by the bulb 408 do not define a plane, and the inclined fluid directing jets 410 induce a fluid flow vortex around the bulb 408. Each inclined fluid directing jet assembly 410 may be oriented to direct an fluid flow toward the surface of the bulb 408. In at least one embodiment, the inclined fluid directing jets 410 may be oriented to direct the fluid flow generally toward the hip of the bulb 408. Inclined fluid directing jets 410 may reduce localized gradients and lower the impingement angle on non-cylindrical envelopes.

Figure 5:
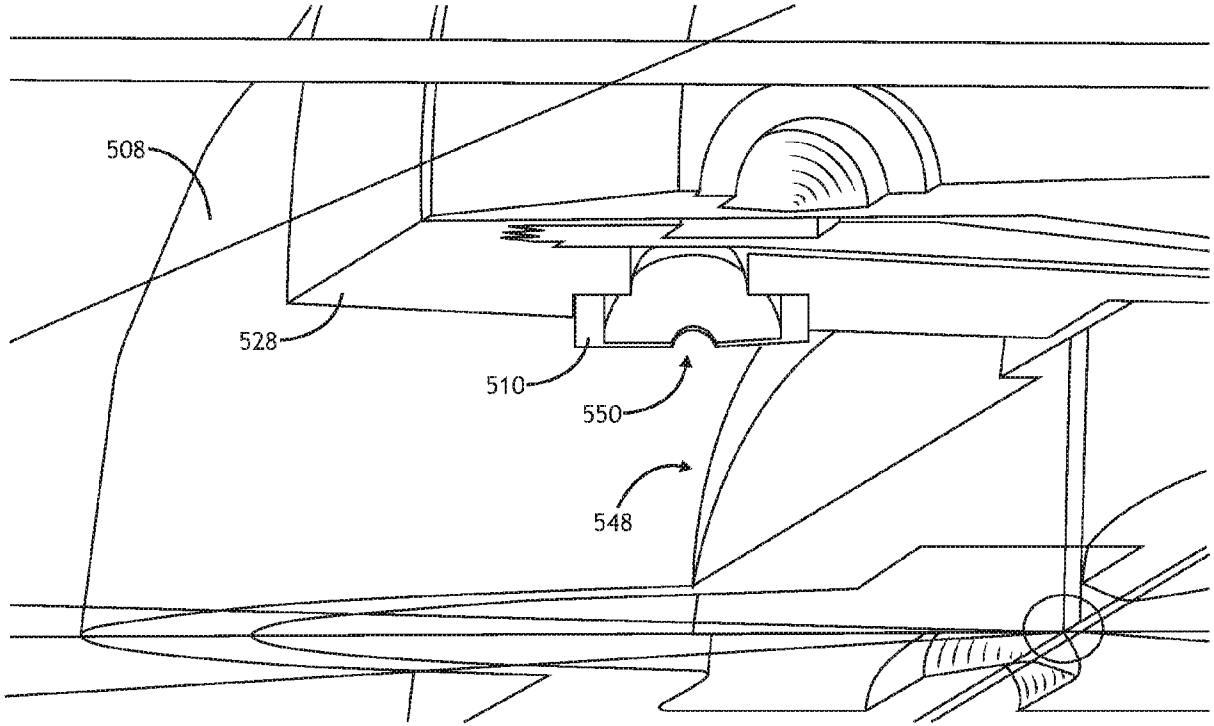
FIG. 5 shows a cross-sectional, detail, overhead view of an input portion of one embodiment of the present invention.

Referring to FIG. 5, a cross-sectional, detail, overhead view of an input portion of one embodiment of the present invention is shown. An input portion according to at least one embodiment of the present invention may include a pilot jet assembly 528 configured as a manifold to receive a cooling fluid and distribute the cooling fluid to a plurality of fluid directing jets 510, each fluid directing jet 510 defining a nozzle 550 configured to direct a fluid toward or around a bulb 508 a bulb such that the fluid may adhere to the surface of the bulb 508 and cool the bulb 508, or redistribute heat around the surface of the bulb 508 or both. In at least one embodiment, the fluid directing jets 510 direct the cooling fluid toward a hip portion 548 of the bulb 508.

Heat load on the bulb 508 during operation is applied to the bulb 508 equator (due to radiation absorption of the glass) and at the top part of the bulb 508 (due to convection). The bottom part of the bulb 508 tends to be colder and tends to have stagnant areas for the internal gas circulation. Directing an external cooling fluid flow from the hot parts of the bulb 508 to the base of the bulb 508 allows increasing the temperature of the base, creating a more uniform temperature profile for the bulb 508, reduces thermal stress, decreases solarization, and helps to maintain all parts of the bulb 508 in a desired temperature range. Control of the temperature for the base part of the bulb 508 is also important in applications requiring volatilization of species inside of the bulb 508, e.g., for Hg or $H_2O$ containing bulbs 508.

Figure 6:
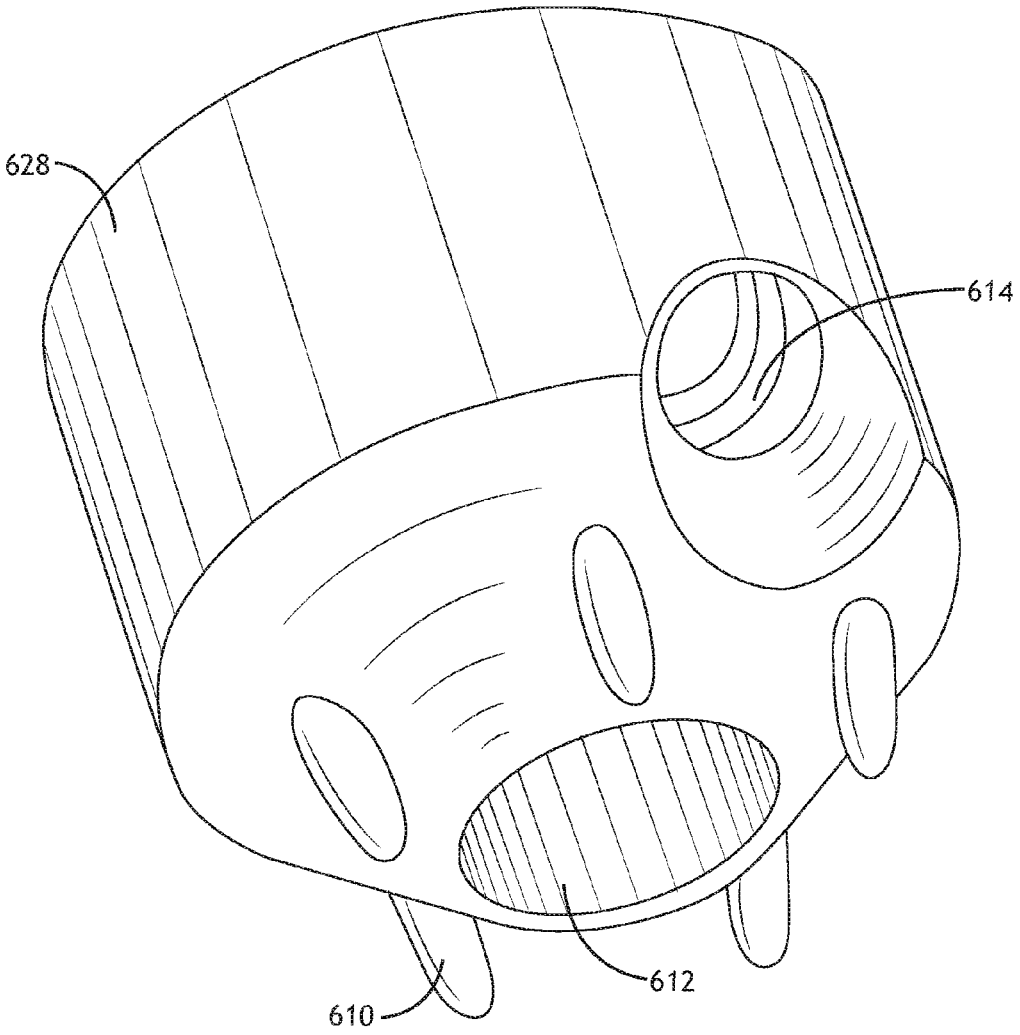
FIG. 6 shows a perspective, detail view of a pilot jet assembly according to one embodiment of the present invention.

Referring to FIG. 6, a perspective, detail view of a pilot jet assembly 628 according to one embodiment of the present invention is shown. The pilot jet assembly 628 defines an input portion 614 for receiving a cooling fluid. The pilot jet assembly 628 distributes the cooling fluid to a plurality of fluid directing jets 610 arranged regularly around a surface of the pilot jet assembly 628. During operation, significant pressure levels are established inside the pilot jet assembly due to the mechanical design and fluid will uniformly flow out from each fluid directing jet 610. The fluid directing jets 610 direct the cooling fluid toward a bulb. The bulb may be connected to a power source by passing a node of the bulb through a bulb access portion 612 defined by the pilot jet assembly 628. The plurality of fluid directing jets 610 may be straight or inclined to produce a vortex around the bulb.

In at least one embodiment, the pilot jet assembly 628 may be installed at the base of a bulb in another design variation. There may be an external transparent shield around the bulb that allows directing of cooling fluid flow and/or containing additional species of the cooling jet such as overheated water vapor near the bulb.

Figure 7:
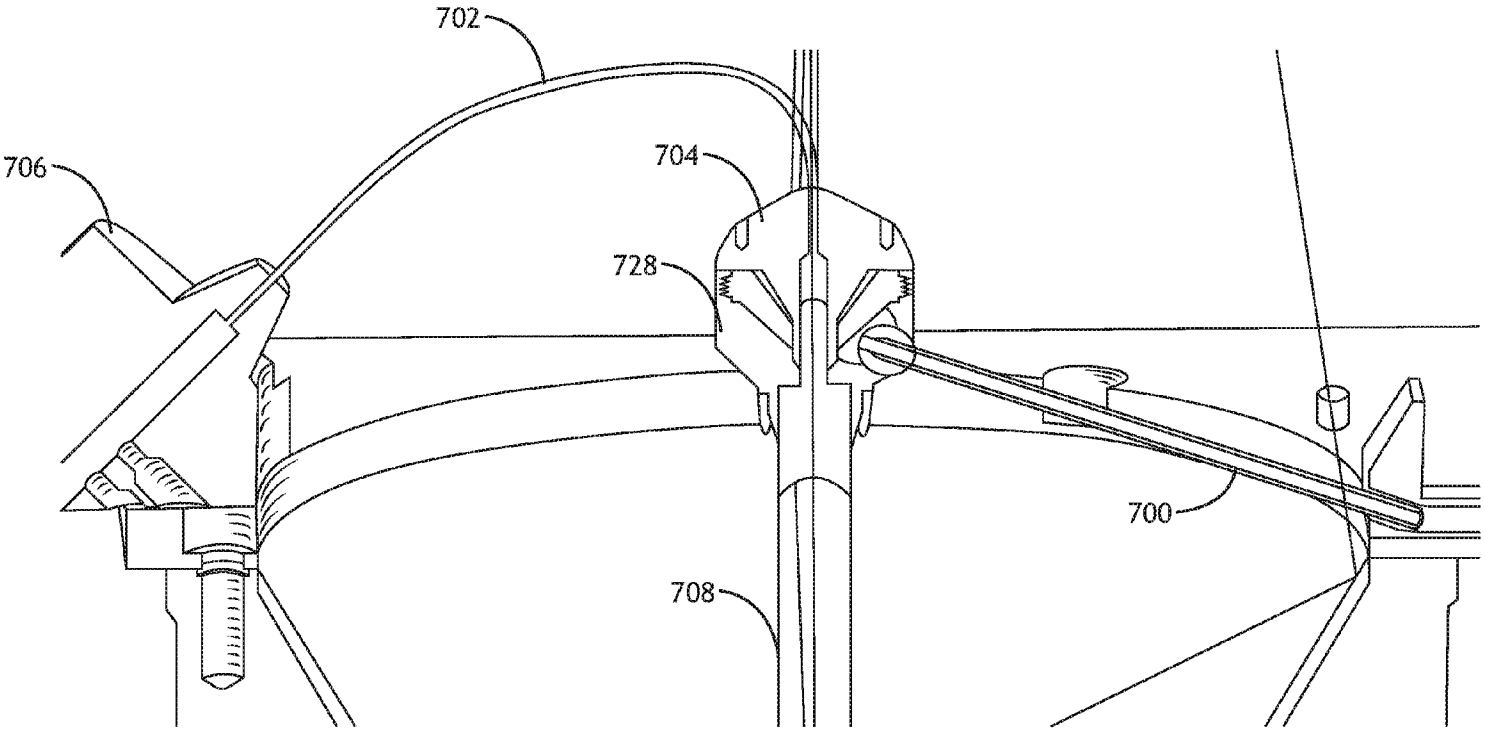
FIG. 7 shows a cross-sectional, detail view of an input portion of another embodiment of the present invention.

Referring to FIG. 7, a cross-sectional, detail view of an input portion of another embodiment of the present invention is shown. In at least one embodiment, a lamp includes a bulb securing locknut 704 that connects one node of a bulb 708 to a power source 706 through a delivery wire 702. The bulb securing locknut 704 may hold an annular nozzle 728 in relation to the bulb 708. The annular nozzle 728 receives a fluid flow through an input 700 and directs fluid over the bulb 708.

Figure 8:
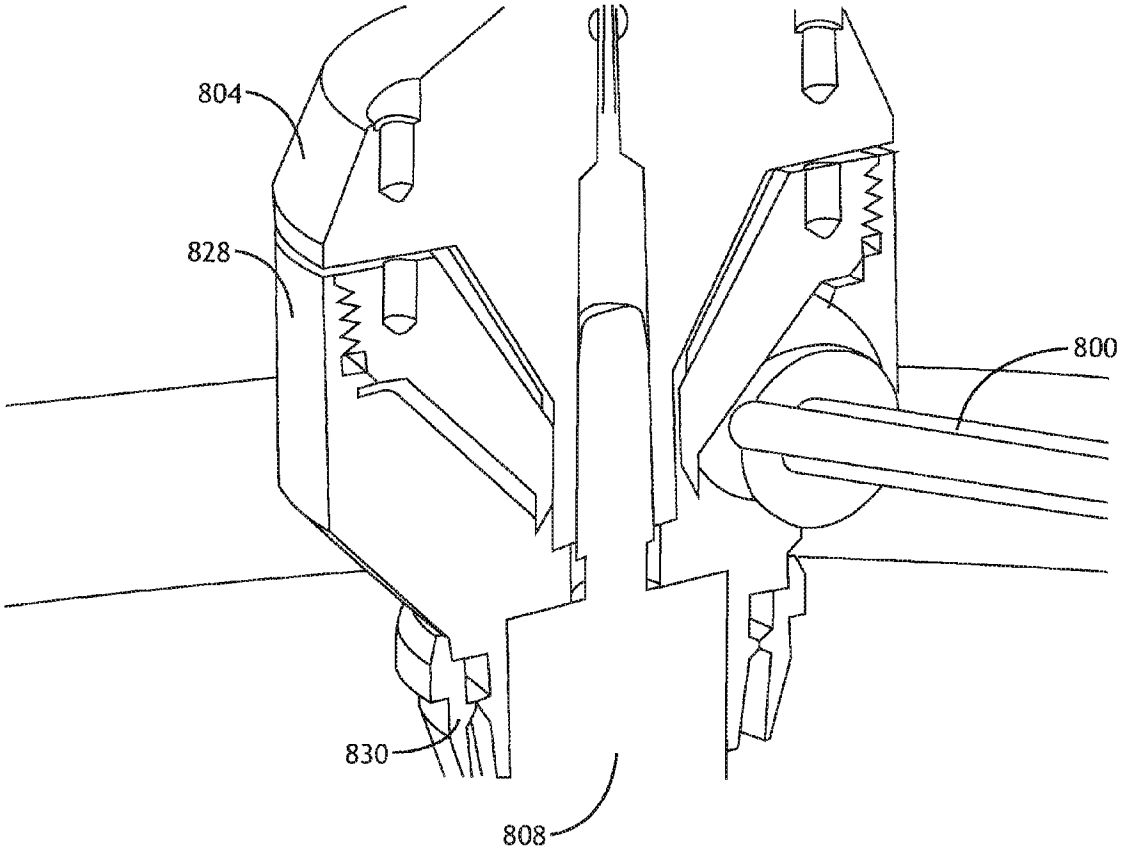
FIG. 8 shows a cross-sectional, detail view of an input portion of another embodiment of the present invention.

Referring to FIG. 8, a cross-sectional, detail view of an input portion of another embodiment of the present invention is shown. The input portion includes a bulb securing locknut 804 to hold an annular nozzle 828 in relation to a bulb 808. The annular nozzle 828 receives a fluid flow through an input 800 and directs fluid over the bulb 808 and a fluid directing collar 830 that defines one or more fluid chambers configured to create a mantle of cooling fluid circumferentially around the bulb 808.

Figure 9:
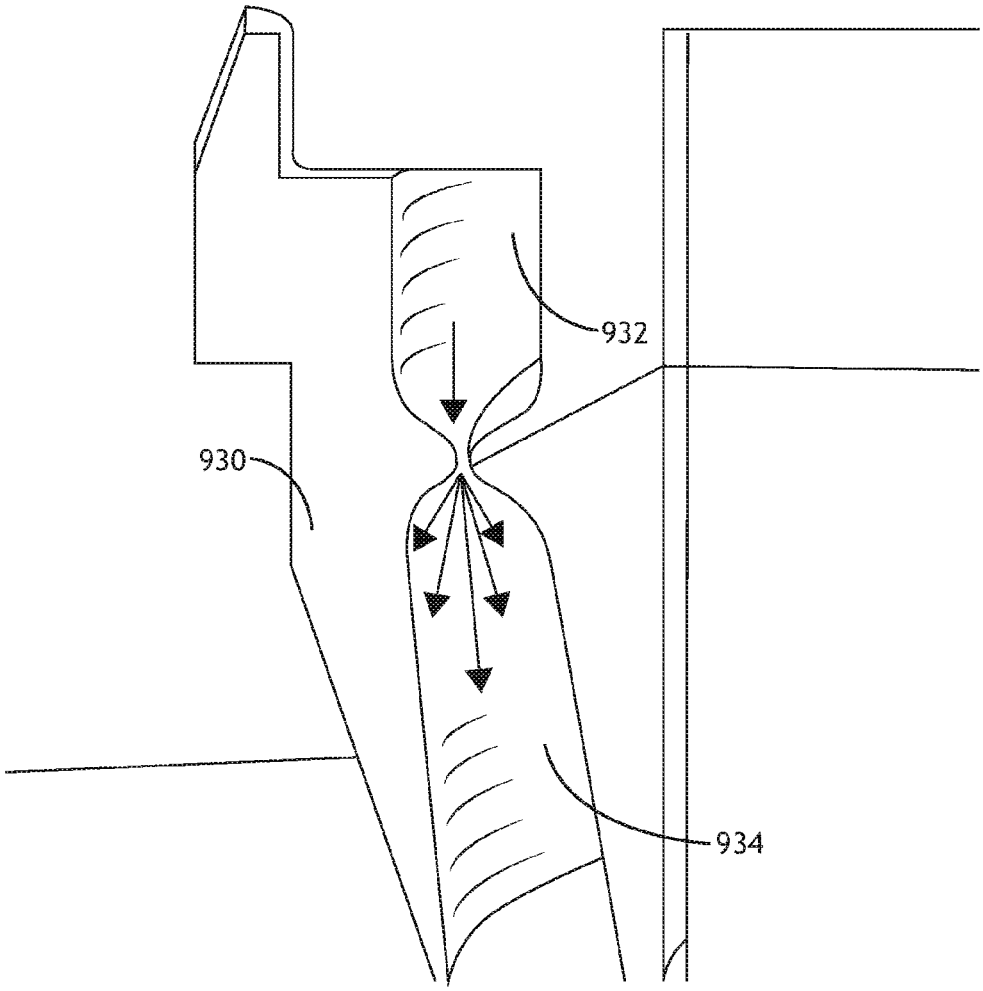
FIG. 9 shows a perspective, detail view of an annular nozzle according to another embodiment of the present invention.

Referring to FIG. 9, a perspective, detail view of an annular nozzle according to another embodiment of the present invention is shown. The annular nozzle may include a fluid directing collar 930 that defines one or more fluid chambers 932, 934 configured to create a mantle of cooling fluid circumferentially around the bulb. An upper fluid chamber 932 and lower fluid chamber 934 may be separated by a gap configured to regulate fluid pressure and flow. In one embodiment, the gap may be 0.100 mm. In another embodiment, the gap may be 0.075 mm. The size of the gap may define the fluid flow between the upper fluid chamber 932 and the lower fluid chamber 934, and therefore around the bulb.

Additionally, the present invention may include an exhaust for the cooling gas located at the base of the bulb. Exhaust helps to direct fluid flow around the bulb and to the base. Exhaust can be augmented and/or controlled by creating negative pressure in the exhaust line.

Figure 10:
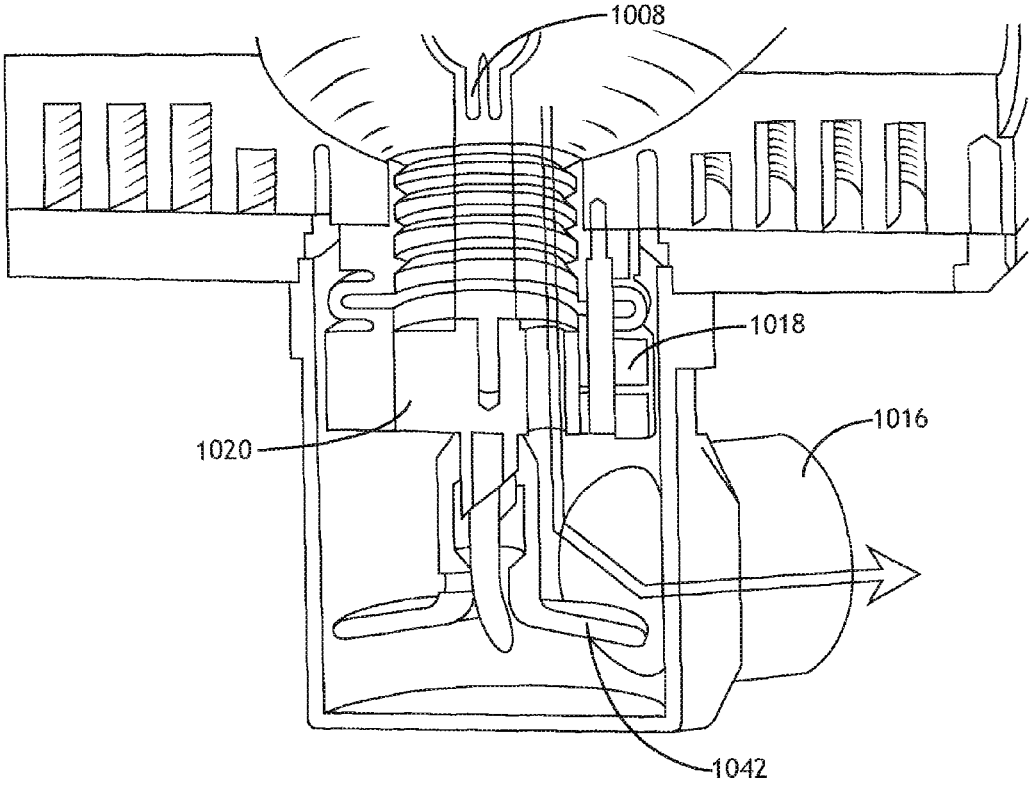
FIG. 10 shows a cross-sectional, detail view of an output portion of one embodiment of the present invention.

Referring to FIG. 10, a cross-sectional, detail view of an output portion of one embodiment of the present invention is shown. The output portion may include a vented bulb securing element 1020 configured to hold a node of a bulb 1008. The vented bulb securing element 1020 may be held in place by a slipclamp 1018. The slipclamp 1018 may comprise a conductive path to a water channel. The slipclamp 1018 may also include baffles configured to direct UV. The vented bulb securing element 1020 and slipclamp 1018 may be substantially contained within an output cap 1016. The output cap 1016 may include one or more deflectors 1042 to deflect fluid flow to an output. The deflectors 1042 may allow electrical connection to a bulb 1008 while protecting such electrical connection from heat generated by the bulb 1008 and fluid flow after absorbing such heat.

Figure 11:
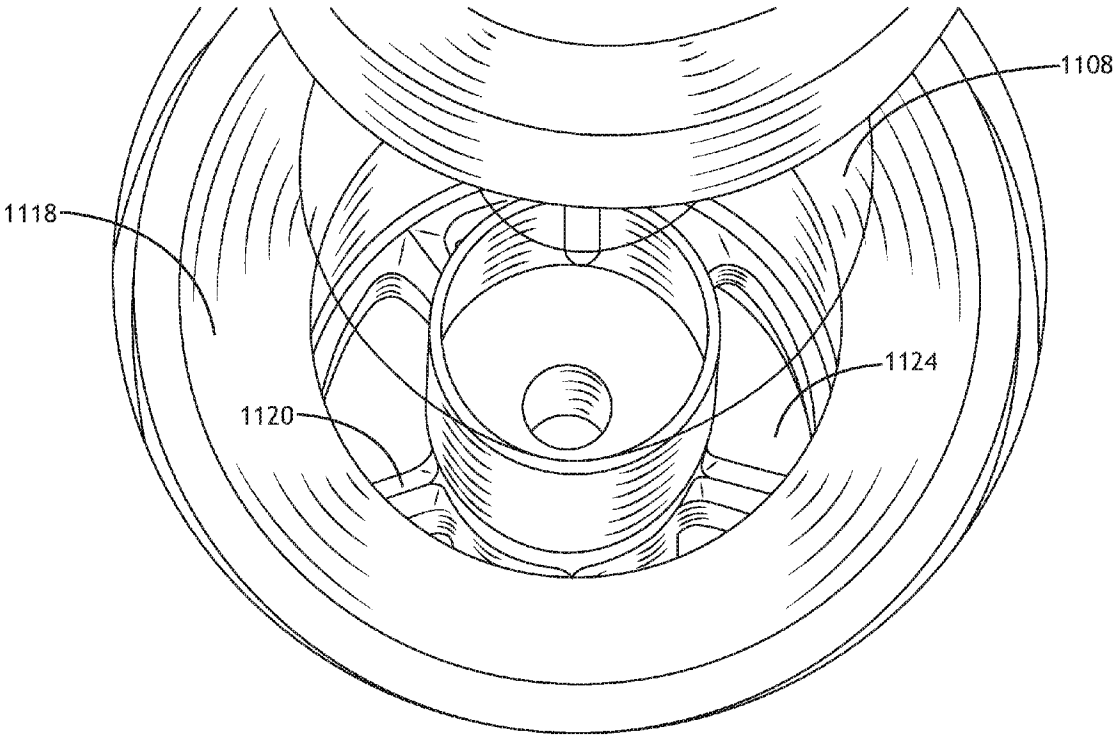
FIG. 11 shows a perspective view of an output portion of one embodiment of the present invention.

Referring to FIG. 11, a perspective view of an output portion of one embodiment of the present invention is shown. Fluid flowing over the surface of a bulb 1108 may pass through one or more vents 1124 defined by a vented bulb securing element 1120. The vented bulb securing element 1120 may be held in place by an output slipclamp 1118.

Figure 12:
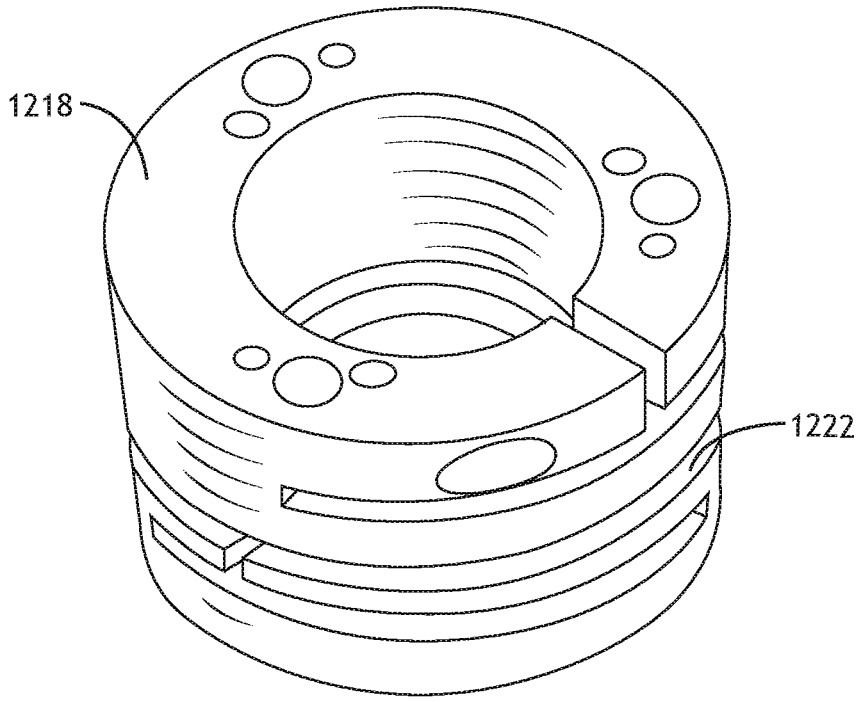
FIG. 12 shows a perspective, detail view of an output slipclamp according to one embodiment of the present invention.
Figure 13:
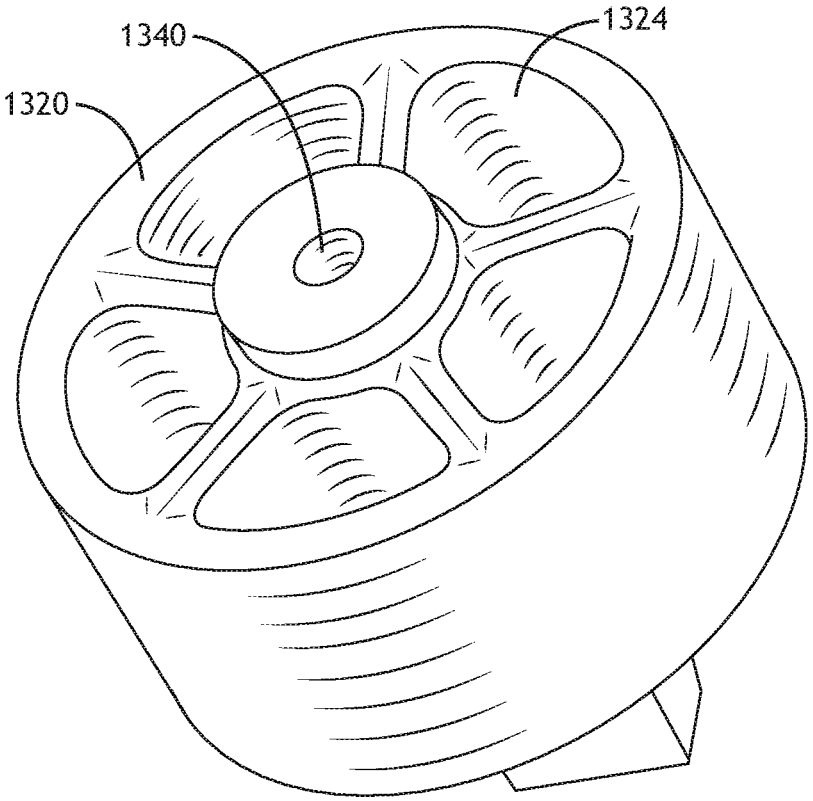
FIG. 13 shows a perspective, detail view of a vented bulb securing element according to one embodiment of the present invention.

Referring to FIG. 12, a perspective, detail view of an output slipclamp 1218 according to one embodiment of the present invention is shown. The slipclamp 1218 may include one or more fluid channels 1222 for directing a cooling fluid around the slipclamp 1218. The slipclamp 1218 may be configured to securely hold a vented bulb securing element Referring to FIG. 13, a perspective, detail view of a vented bulb securing element 1320 according to one embodiment of the present invention is shown. The vented bulb securing element 1320 may define one or more vents 1324 to allow fluid flowing over a bulb secured by the vented bulb securing element 1320 to pass through. Furthermore, the vented bulb securing element 1320 may include one or more heat sensitive elements 1340 such as a thermocouple. Heat sensitive elements 1340 allow a bulb cooling system to alter the rate of flow of a cooling fluid based on the temperature of a bulb. Temperature based feedback from heat sensitive elements 1340 provides a means of reducing the temperature to safe limits of less than 600° C. for most glass material used in lamp manufacturing.

Figure 14:
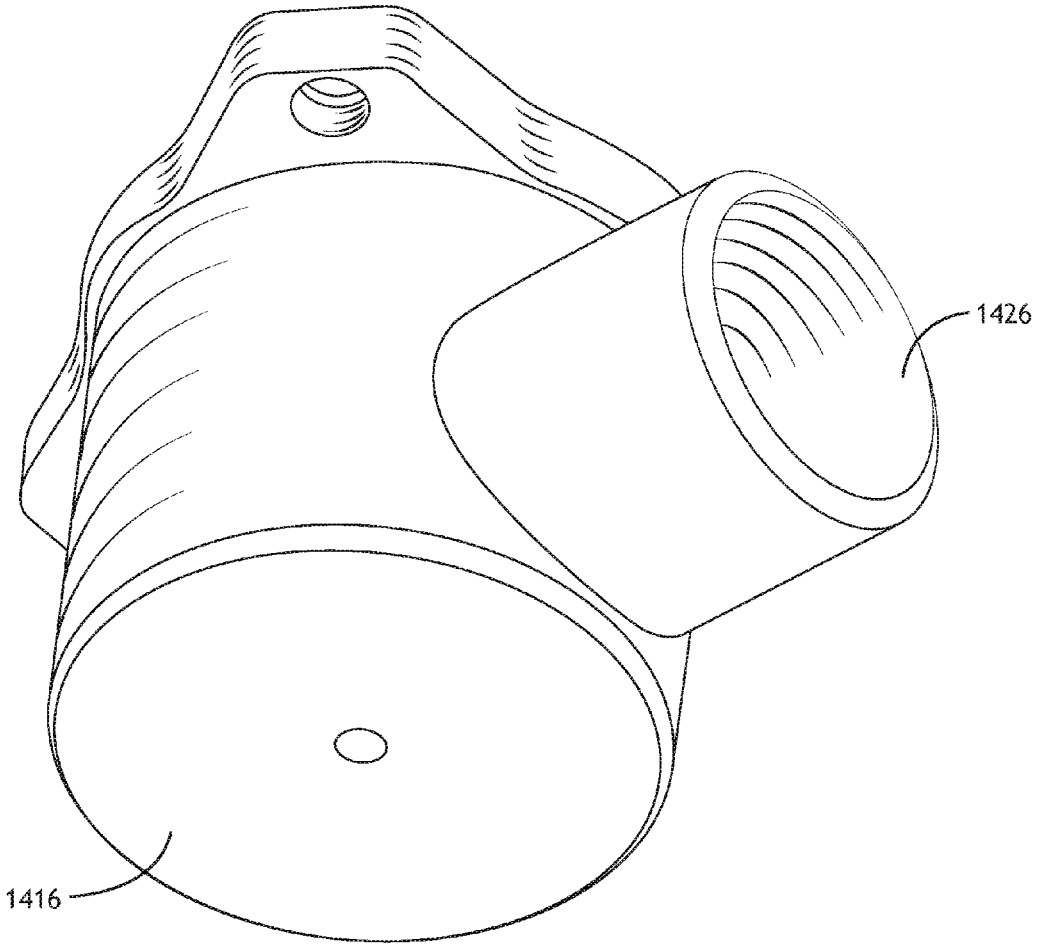
FIG. 14 shows a perspective, detail view of an output cap according to one embodiment of the present invention.

Referring to FIG. 14, a perspective, detail view of an output cap 1416 according to one embodiment of the present invention is shown. The output cap 1416 may contain a slipclamp and a venter bulb securing element. Fluid flowing through vents in the vented bulb securing element may pass through to exit through an outlet 1426.

Figure 15:
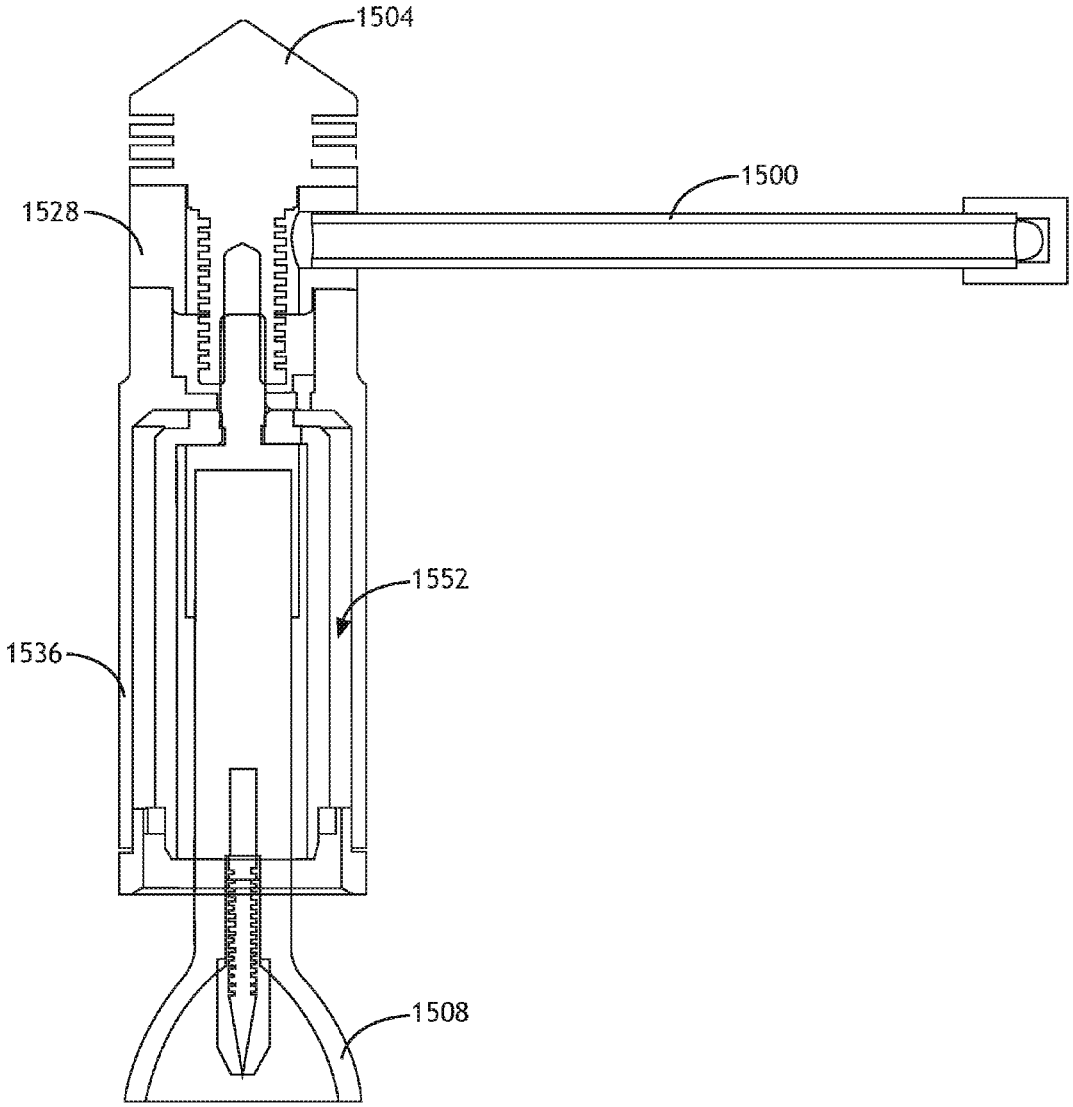
FIG. 15 shows a cross-sectional view of another embodiment of the present invention.

Referring to FIG. 15, a cross-sectional view of another embodiment of the present invention is shown. In at least one embodiment, a lamp holding node 1504 allows electrical contact with one node of a bulb 1508. The lamp holding node 1504 secures the bulb 1508 to a cooling fluid manifold 1528 having a cooling fluid input 1500. Cooling fluid flows through the cooling fluid input 1500 under some pressure into the cooling fluid manifold 1528. From there, the cooling fluid may flow into a fluid space 1552 defined by a cooling fluid jacket 1536 surrounding a portion of the bulb 1508. The cooling fluid jacket 1536 may create a directed, substantially laminar flow over the surface of the bulb 1508 to cool portions of the bulb 1508 not surrounded by the cooling fluid jacket 1536. The lamp holding node 1504 or cooling fluid manifold 1528 or both may include heat sink portions to further enhance cooling.

Figure 16:
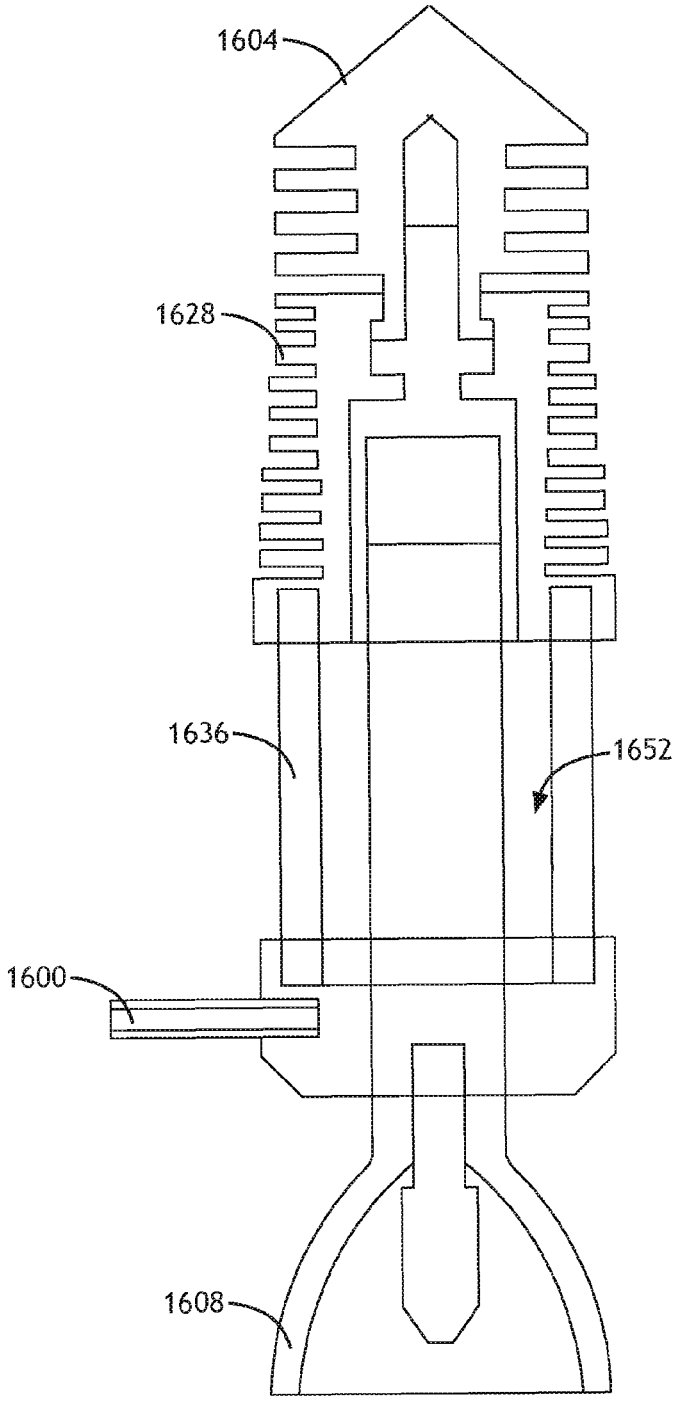
FIG. 16 shows a cross-sectional view of another embodiment of the present invention.

Referring to FIG. 16, a cross-sectional view of another embodiment of the present invention is shown. A lamp holding apparatus may include a lamp holding node 1604 configured to hold a node of a lamp 1608 and allow electrical contact with the node. Furthermore, the lamp holding node 1604 may secure a heatsink 1628 to the lamp 1608 and hold a cooling fluid jacket 1636 in place. The cooling fluid jacket 1636 may define a cooling fluid space 1652. Furthermore, the cooling fluid jacket 1636 may comprise a material for absorbing certain radiation such as unused UV radiation. One embodiment of the cooling fluid jacket 1636 may be a thin flexible glass sheet rolled around the bulb 1608 in a tube fashion. The cooling fluid jacket 1636 may have antireflection coating deposited on internal or external surfaces or both.

A cooling fluid flows through an input 1600 and forms a substantially laminar fluid flow around the bulb 1608. Furthermore, the cooling fluid may flow into the cooling fluid space 1652.

Figure 17:
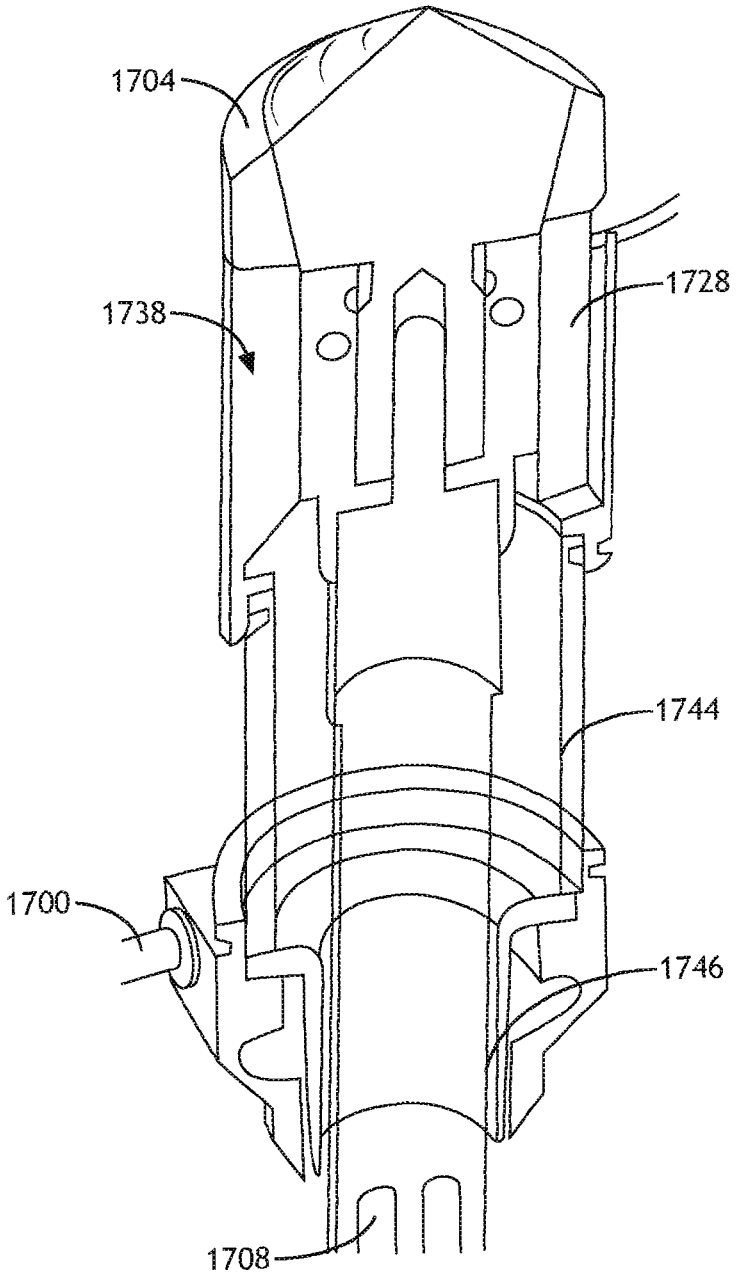
FIG. 17 shows a cross-sectional, perspective view of another embodiment of the present invention.

Referring to FIG. 17, a cross-sectional, perspective view of another embodiment of the present invention is shown. A lamp may include a bulb securing locknut 1704 holds a node of a bulb 1708 and allows a supply current to be applied to the bulb 1708. A cooling fluid supply tube 1700 supplies a cooling fluid. In at least one embodiment, the cooling fluid may flow into a space defined by a thermally fit nozzle 1746.

The thermally fit nozzle 1746 may restrict delivery of the cooling fluid. The thermally fit nozzle 1746 may define jets that may comprise approximately 70% of fluid supply tube 1700 cross-section. Jetted injection may pull fluid over heat sinks. An insulating spacer 1744 such as a fused quartz insulating spacer may define a fluid space to direct fluid flow. In at least one embodiment, a bulb cooling apparatus may include a heatsink 1728 configured to facilitate fluid flow 1738 through a space defined by an insulating spacer 1744.

The present invention thereby reduces residual stress during and after operation in arc lamps operated in conventional continuous DC discharge mode or laser pumped and sustained plasma modes resulting in an extension of the useful operation lifetime for these lamps.

It is believed that the present invention and many of its attendant advantages will be understood by the foregoing description of embodiments of the present invention, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An apparatus for cooling a bulb, comprising:

a cooling fluid manifold configured to receive a cooling fluid and distribute the cooling fluid substantially uniformly around a perimeter of the bulb; and one or more cooling fluid distribution elements disposed on the cooling fluid manifold, at least one of the cooling fluid distribution elements comprising an annular nozzle defining an upper chamber and a lower chamber connected by a restricted space, the upper chamber configured to receive the cooling fluid and the lower chamber configured to distribute the cooling fluid from the cooling fluid manifold along a surface of the bulb, wherein the one or more cooling fluid distribution elements comprise airfoils oriented to produce a substantially laminar cooling fluid flow along the surface of the bulb, wherein the restricted space is configured to control a flow of cooling fluid from the upper chamber to the lower chamber, and further configured to produce Joule-Thomson cooling of the cooling fluid.

2. The apparatus of claim 1, wherein the one or more cooling fluid distribution elements comprise a plurality of straight pilot jets substantially evenly distributed along a surface of the cooling fluid manifold to direct the cooling fluid toward a hip portion of the bulb.

3. The apparatus of claim 1, wherein the one or more cooling fluid distribution elements comprise a plurality of inclined pilot jets substantially evenly distributed along a surface of the cooling fluid manifold to produce a cooling fluid vortex around along the surface of the bulb.

4. The apparatus of claim 1, wherein the one or more cooling fluid distribution elements comprises an airfoil to direct the cooling fluid.

5. The apparatus of claim 1, further comprising an exhaust element configured to facilitate the flow of the cooling fluid over the surface of the bulb and through an exhaust outlet.

6. The apparatus of claim 5, wherein the exhaust element comprises a thermocouple configured to measure a temperature of the bulb.

7. The apparatus of claim 6, further comprising a processor connected to the thermocouple, the processor configured to:

receive temperature data from the thermocouple; and alter a flow of cooling fluid to the cooling fluid manifold based on the temperature data.

8. The apparatus of claim 1, wherein the cooling fluid manifold is configured to receive and distribute the cooling fluid at a rate sufficient to maintain a surface temperature of an arc lamp bulb at less than 600° C. during normal operation.

9. An apparatus for distributing heat along a surface of a bulb, comprising:

a cooling fluid manifold configured to receive a cooling fluid and distribute the cooling fluid substantially uniformly around a perimeter of the bulb with one or more annular nozzles, each defining an upper chamber configured to receive the cooling fluid and a lower chamber configured to project the cooling fluid along a surface of the bulb; the upper chamber and lower chamber connected by a restricted space configured to control a flow of cooling fluid from the upper chamber to the lower chamber; and a cooling fluid jacket connected to the cooling fluid manifold, the cooling fluid jacket configured to surround a portion of the bulb corresponding to a first node of the bulb, wherein the cooling fluid jacket comprises glass treated to absorb ultraviolet light.

10. The apparatus of claim 9, wherein the cooling fluid manifold is configured to be disposed between the cooling fluid jacket and a hip portion the bulb.

11. The apparatus of claim 9, further comprising a vented outlet element configured to connect to a second node of the bulb and allow cooling fluid to pass through to an exhaust area.

12. The apparatus of claim 11, wherein the vented outlet element comprises a thermocouple configured to measure a temperature of the bulb.

13. The apparatus of claim 12, further comprising a processor connected to the thermocouple, the processor configured to:

receive temperature data from the thermocouple; and alter a flow of cooling fluid to the cooling fluid manifold based on the temperature data.

14. The apparatus of claim 9, wherein the cooling fluid manifold is configured to receive and distribute the cooling fluid at a rate sufficient to maintain a surface temperature of an arc lamp bulb at less than 600° C. during normal operation.

15. A method for cooling a bulb, comprising:

injecting a cooling fluid into a cooling fluid distribution manifold;

distributing the cooling fluid around a perimeter of the bulb with one or more annular nozzles defining an upper chamber configured to receive the cooling fluid and a lower chamber configured to project the cooling fluid along a surface of the bulb; the upper chamber and lower chamber connected by a restricted space configured to control a flow of cooling fluid from the upper chamber to the lower chamber; and producing a substantially laminar cooling fluid flow over the surface of the bulb, wherein the substantially laminar cooling fluid flow is directed generally along an axis defined by a first node of the bulb and a second node of the bulb.

16. The method of claim 15, further comprising passing the cooling fluid through a restricted opening to produce Joule-Thompson cooling.

17. The method of claim 15, further comprising creating a negative pressure area at a node of the bulb, wherein the negative pressure area is configured to facilitate cooling fluid flow over a surface of the bulb to an exhaust area.

18. The method of claim 15, further comprising:

detecting a temperature associated with at least a portion of the bulb; and adjusting a rate of injection based on the temperature.

* * * * *